United States Patent [19]

Taylor

[11] 4,394,132

[45] * Jul. 19, 1983

[54] PARTICULATE COAL-IN-LIQUID MIXTURE AND PROCESS FOR THE PRODUCTION THEREOF

[75] Inventor: David W. Taylor, Edgemont, Pa.

[73] Assignee: Ergon, Inc, Jackson, Miss.

[ * ] Notice: The portion of the term of this patent subsequent to Sep. 8, 1998, has been disclaimed.

[21] Appl. No.: 151,358

[22] Filed: May 19, 1980

[51] Int. Cl.[3] ..... C10L 1/32

[52] U.S. Cl. ..... 44/51; 44/1 A; 44/1 R; 241/5

[58] Field of Search ..... 44/1 A, 1 R, 51, 24

[56] References Cited

U.S. PATENT DOCUMENTS

| | | | |
|---|---|---|---|
| 1,390,231 | 9/1921 | Bates | 44/51 |
| 1,420,165 | 6/1922 | Trent | 44/1 A |
| 1,529,706 | 3/1925 | Merz . | |
| 1,939,587 | 12/1933 | Adam et al. | 44/51 |
| 2,162,200 | 6/1939 | Kiesskalt et al. | 44/51 |
| 4,138,226 | 2/1979 | Verschuur | 44/51 |
| 4,288,231 | 9/1981 | Taylor | 44/1 R |

FOREIGN PATENT DOCUMENTS

| | | |
|---|---|---|
| 2261330 | 9/1975 | France . |
| 1523193 | 8/1978 | United Kingdom . |

*Primary Examiner*—Jacqueline V. Howard

*Attorney, Agent, or Firm*—Dann, Dorfman, Herrell and Skillman

[57] ABSTRACT

Improved particulate coal-in-liquid mixtures and a process for the production thereof wherein, prior to mixing with liquid, the coal component of the mixture is finally divided in a substantially airtight fluid energy attrition mill, and thereafter separated from ash particles. The particulate coal product thus produced is mixed with a suitable liquid to provide a product which may be used in coal gasification or hydrogenation processes, or as a composite fuel, and which can be stored for extended periods without appreciable settling out of the coal from the mixture.

49 Claims, 1 Drawing Figure

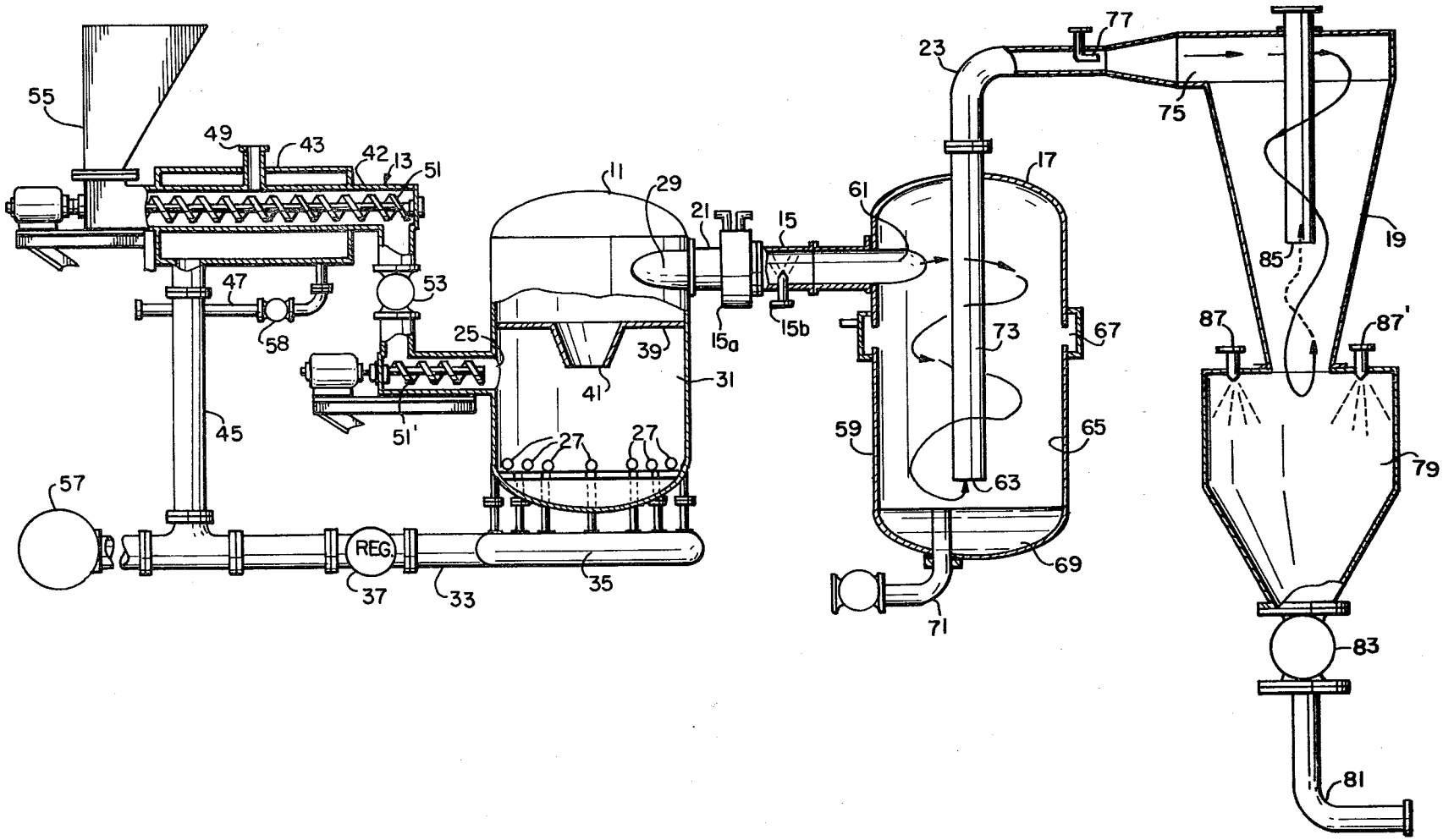
REG

PARTICULATE COAL-IN-LIQUID MIXTURE AND PROCESS FOR THE PRODUCTION THEREOF

BACKGROUND OF THE INVENTION

This invention relates to an improved process for the production of particulate coal-in-liquid mixtures and to the products produced by the process.

The ever-increasing cost and uncertainty of supply of oil on the world market has generated renewed interest in coal as a fuel source. Recent developments in coal processing technology have included new and improved methods of coal gasification and hydrogenation to produce liquid fuels and chemicals. Also, efforts are being made to demonstrate the feasability of replacing oil with coal-oil mixtures for use in both electric power generation and in industrial heating and steam generation. These applications of coal involve mixing the coal in a finely divided state with a variety of liquids. For example, certain gasification processes call for the mixing of comminuted coal with various grades or types of oil; hydrogenation requires mixing finely divided coal with a hydrogen donor solvent; and the preparation of coal-oil mixtures, as the name implies, involves the mixing of particulate coal with oil. Also, coal is often combined with water to produce a pumpable slurry for transportation from the mine to coal processing units or power plants.

A major problem attendant the use of coal-in-liquid mixtures is that the coal has a tendency to settle out of the liquid during transportation or storage. This problem most often manifests itself in the plugging of feed lines of the coal processing equipment or in the fouling of pumps and valves in storage vessels and transportation pipe lines. Various solutions to the settling out problem have been proposed, such as the addition of stabilizing agents to the coal-in-liquid mixtures, the employment of mechanical stirring devices in storage tanks, the careful regulation of flow rates during transportation, and the employment of processing equipment designs which minimize the problem, such as laying out of piping to avoid dead spots, vertical mounting of valves, and the like. However, all of these proposed solutions translate into increased construction or operating costs for the particular process involved. In addition, the use of stabilizing agents tends to diminish the reactivity of the coal particles, making subsequent processing thereof less efficient.

Another problem associated with the use of particulate coal-in-liquid mixtures is that the particulate component of the mixtures, which includes ash particles generated during milling of the coal, cause rather severe erosion of the pumps, valve, pipes, feedlines, and burners of coal processing or combustion apparatus. The ash particles, being harder than the coal particles, are particularly abrasive. Erosion becomes especially pronounced when the particle sizes are on the order of 40 microns or greater, which is typically the mid-size of coal pulverized in air-swept mechanical grinding mills.

Coal-in-liquid mixtures containing coal particles of greater than 40 microns have other disadvantages, as well. For example, in hydrogenation processes, the larger the coal particles, the longer they take to liquify, which results in long reactor residence times and an excessive amount of unreacted coal in output streams. Similarly, when these relatively large size particles are present in composite fuels, such as coal-oil mixtures, they do not undergo complete combustion in the normal furnace residence periods available in conventional oil and gas furnaces. As a result, the ash particles impinge on surfaces of the furnace, e.g., boiler tubes, in a slagging condition.

The development of methods for producing stable particulate coal-in-liquid mixtures having uniformly small particle sizes, as well as reduced ash particle content, continues to be a highly desired objective.

SUMMARY OF THE INVENTION

It has now been discovered, in accordance with the present invention, that coal which has been reduced to micron-sized particles in a substantially air-free environment may be combined with a variety of liquids to provide highly stable coal-in-liquid mixtures. These mixtures may be stored for long periods without requiring the use of stabilizing agents or mechanical agitation to prevent settling out of the coal from the mixture. Moreover, the equipment used to process the particulate coal-in-liquid mixtures of the present invention may be of a simpler design than that used heretofore. The extremely fine particle size of the particulate component of coal-in-liquid mixtures of the present invention tend to minimize erosion of coal processing and combustion apparatus. The fine particle size of the coal also contributes to the efficient processing of these mixtures for the production of liquid fuels, as well as to the efficient combustion of these mixtures as composite fuels. Further, combustion of the composite fuels produced in accordance with the present invention is extremely efficient.

Finely divided coal particles which are produced in a substantially air-free environment have been found to possess high surface reactivity as compared with particulate coal produced in air-swept mechanical mills, such as those commonly used in prior art process for making coal-in-liquid mixtures. This high surface reactivity contributes to the stability of the coal-in-liquid mixtures produced in accordance with the present invention.

The substantial exclusion of air during the milling operation has also been found to impart a hydrophobic quality to the finely divided coal particles. By contrast, the ash particles generated during the milling operation retain their innate hydrophilic character. Because of this distinct difference in affinity for water between the coal particles, on the one hand, and the ash particles, on the other hand, these two particulate materials may be readily separated from one another, using a variety of well-known aqueous separation techniques. Reducing the amount of ash particles in the coal-in-liquid mixtures lessens the aforementioned erosion problem. In addition, when the coal-in-liquid mixture is to be used as a composite fuel, beneficiation of the coal by ash removal results in a more environmentally acceptable fuel.

It can thus be seen that the present invention provides a process for conditioning raw coal to impart thereto characteristics which contribute to the production of improved coal-in-liquid mixtures.

In general, the process of the present invention involves grinding raw coal in a fluid energy attrition mill from which air is excluded to produce a hydrophobic coal-fraction and a hydrophilic ash-fraction. Thereafter, the coal fraction and ash-fraction are contacted with an aqueous liquid whereby the particles constituting the ash fraction are wetted, but the particles constituting the coal-fraction remain substantially dry, i.e., the coal particles have no measurable amount of water associated therewith. Subsequently, the wetted ash-fraction is separated from the coal-fraction, which is then combined with the desired liquid to give a particulate coal-in-liquid mixture.

More specifically, the process of the present invention is preferably carried out in a substantially airtight fluid energy attrition mill which produces coal- and ash-fractions in which the predominent particle size is less than about 40 microns. These very fine particle sizes are primarily responsible for the reduction of erosion in coal processing and combustion apparatus. Studies have shown that a reduction in particle size of one micron lessens the abrasiveness of the particles by a power of four. The preferred fluid for operation of the mill is superheated steam, which performs a dual function in that it causes size reduction of the particles by effecting impacts therebetween and acts as a vehicle for transporting the micron-sized mill effluent to a suitable separator and, subsequently to a suitable mixing device.

Upon discharge from the mill, the coal-fraction, ash-fraction and carrier medium are cooled. Cooling of the mill effluent may be accomplished by heat exchange, either directly by wetting with a small amount of aqueous liquid, or indirectly by use of a cooling jacket, condenser or the like. After having been subjected to elevated temperatures and becoming partially dehydrated, the ash particles, when cooled, provide nucleation sites for condensation of water vapor. Accordingly, water adheres to the ash particles which then have a tendency to agglomerate, thereby enhancing their separability from the coal particles. Contact with water does not wet the coal particles, however, because of the hydrophobic characteristic imparted thereto by grinding in the absence of air. Thus, the particles constituting the coal-fraction remain substantially dry.

Separation is preferably carried out in a water-wall separator. The use of steam as a carrier medium in the process lends itself to such an aqueous separation of the coal from the ash particles.

The coal particles, which have been substantially freed from ash, are then mixed with a suitable liquid to form particulate coal-in-liquid mixtures, which can be stored and transported without the occurrence of undesirable settling out of the coal from the mixture.

The production of composite fuels comprising coal-oil mixtures is a very important aspect of the present invention. Widespread use of coal-oil mixtures will allow coal to assume a greater role as an energy source, thus conserving existing oil reserves, but without necessitating complete conversion of existing power plans to burn coal alone. Additionally, composite fuels prepared in accordance with the present invention produces relatively low levels of particulate emissions upon combustion, since the ash content of the fuel may be as little as from about ¼ to about 2½ percent ash by weight. Moreover, the high surface reactivity of the coal component of composite fuels produced by this invention renders the combustion of these fuels more complete and efficient.

From the foregoing summary, it will be appreciated that the process of the present invention provides particulate coal-in-liquid mixtures having high stability, without requiring the use of stabilizing agents, mechanical stirrers, or customized equipment.

The process of the present invention also provides particulate coal-in-liquid mixtures which reduces the errosion of coal processing and combustion apparatus as compared with similar mixtures heretofore used.

The process of the present invention also provides coal-in-liquid mixtures which undergo gasification and hydrogenation efficiently to produce liquid fuel and chemicals.

There is also provided, in accordance with the present invention, a process which is capable of producing composite fuel mixtures which burn efficiently and meet existing environmental standards for particulate emissions.

The present invention further provides a means for employing coal as an energy source without converting existing power plants to burn only coal.

Another advantage of the present invention is that it provides a means for conserving existing oil reserves.

The present invention also provides a process for the production of particulate coal-in-liquid mixtures which is capable of continuous operation.

The novel features and advantages of the present invention will become apparent from the following description thereof read in conjunction with the accompanying drawing, the sole FIGURE of which is a cross-sectional elevation illustrating the presently-preferred apparatus for carrying out the process of the present invention.

The drawing shows a series of processing units comprising, in combination, a coal grinding mill 11, a feed unit 13, cooling means 15 for cooling the effluent from the mill, a separator 17, a mixing vessel 19 and means, such as ducts 21 and 23, for transferring the material being processed from one unit to the next.

The grinding mill 11, which is substantially airtight, reduces the coal to particles comprising a coal-fraction and an ash-fraction, a major portion of the particles having a size of less than about 40 microns. The mill is provided with an inlet 25, for introducing raw, untreated coal into the mill, means, such as ejector nozzles 27, for introducing an air-free fluid carrier medium into the mill, and a discharge 29 for withdrawing from the mill the coal-fraction and ash-fraction, which are entrained in the carrier medium.

A particularly preferred grinding mill for practicing this invention is a fluid energy attrition mill of the type disclosed in my co-pending application Ser. No. 21,061, filed Mar. 16, 1979, entitled "Comminution of Pulverulent Material By Fluid Energy", now U.S. Pat. No. 4,219,164 the entire disclosure of which is incorporated herein by reference. Briefly, the preferred grinding mill comprises a generally upright cylindrical pressure vessel 31, as shown in the drawing herein, having a grinding zone at one end and outlet means 41 at the other. The vessel 31 has a generally cylindrical core zone with its axis disposed generally centrally within the vessel between the grinding zone and the outlet means, and an annular peripheral zone surrounding the core zone. The ejector nozzles 27 are arranged circumferentially for injecting an air-free fluid carrier medium into the grinding zone as described more fully in the referenced application. The carrier medium is delivered to the ejector nozzles via inlet pipe 33 and external manifold 35. The rate of delivery of the carrier medium may be controlled by any suitable regulating means, such as regulator 37.

The fluid carrier medium, which, as previously mentioned, is preferably superheated steam, is injected in a direction between a radius to the core zone axis and a line perpendicular thereto. All of the nozzles 27 are disposed at an inclined angle in the grinding zone to inject a primary flow of fluid carrier medium into the vessel through said grinding zone so as to generate an axially-flowing vortex within the core zone. The vessel also has transverse partition means 39 at the outlet end spaced from the grinding zone to intercept the axially-flowing vortex and deflect at least a first portion of the medium therein outwardly into the peripheral zone. The fluid medium deflected into the peripheral zone flows oppositely as a secondary flow into the primary flow issuing from the nozzles 27 and thereby effects a recirculation of the fluid carrier medium within the vessel. Partition 39 has an outlet means 41 therein which is positioned at the upper end of the vortex and permits withdrawal from the mill of a second portion of the fluid medium and with it at least a portion of the coal-fraction and ash-fraction, which are discharged from the vessel through a tangential discharge 29.

Preferably, the coal should be deaerated prior to its introduction into the mill. Deaeration has been found to enhance the surface reactivity and hydrophobicity of the finely divided coal produced in the mill. In this connection, feed unit 13 is provided with a conduit 42 having means for excluding air from the unit and from the untreated coal passing through the conduit 42 before entering the mill. Such means may include jacket 43 containing a fluid heating medium which surrounds conduit 42 for effecting indirect heat transfer with the coal in the feed conduit. The jacket may be provided with a heating medium supply duct 45 and a discharge duct 47 for recirculating the heating medium therethrough. Vent means 49 is provided in the feed conduit 42 to expel water vapor and air driven off from the feed coal as a result of heat exchange between the heating medium and the coal in the feed conduit.

The feed unit 13 may be provided with mechanical air-lock means, such as a screw auger 51, for advancing the untreated coal through the conduit 42. The amount of coal that is fed into the mill may be regulated by rotary seal valve 53. The coal may be delivered through valve 53 directly into the mill, or an additional screw auger 51' may be provided to advance the coal into the mill. A hopper 55 is ordinarily associated with feed conduit 42 to hold a supply of pre-crushed raw coal ($\frac{1}{4}'' \times 0$) in readiness for introduction into the mill.

The fluid heating medium for heating the feed coal and the air-free fluid carrier medium introduced into the grinding mill may originate from a common supply which is preferably a source of steam, such as boiler 57.

After size reduction is accomplished in the mill, transfer duct 21 carries the coal- and ash-fractions entrained in the carrier medium to separator 17. Before the coal and ash particles and the carrier medium enter the separator, they pass through the cooling means 15 where the particles come in contact with an aqueous liquid to cause wetting of the hydrophilic ash particles, while the hydrophobic coal particles, as mentioned above, remain substantially dry.

When steam is employed as the carrier medium, the means for cooling the coal and ash particles may take the form of a condenser or indirect heat exchanger **15*a* disposed within, or surrounding transfer duct 21, the cooled impurities particles providing nucleation sites for condensation of the steam. In this arrangement, cooling element 15*a* reduces the temperature of the particle-laden carrier medium below the dew point of the carrier steam, thereby initiating wetting of the ash particles. However, transfer duct 21 preferably includes a spray nozzle 15*b*** for cooling the steam by direct heat exchange and providing a small amount of condensed water which nucleates on the ash fraction but not on the coal fraction as the fractions pass therethrough. The wetted impurities particles tend to agglomerate becoming more massive than the particles constituting the coal-fraction, and this mass differential enhances the separability of the ash-fraction from the coal-fraction.

The preferred device for separating the coal-fraction from the ash-fraction, as illustrated in the drawing, comprises a vessel 59 having a tangential inlet 61, a central discharge 63 and wall means 65 disposed between said inlet and discharge defining an annular separation zone. The separator is provided with means, such as a weir 67, for introducing a liquid medium, and thus providing the wall means with an aqueous layer.

It should be noted that when steam is employed as the carrier medium, the water in the vicinity of the upper portion of vessel 59 near inlet 61 may serve to effect condensation of the steam on the ash particles, thus obviating a separate cooling element. Similarly, the upper portion of the vessel may be provided with cooling means, such as a heat exchanger (not shown) which is capable of producing a sufficient amount of water in the upper reaches of the separation vessel to provide an aqueous fluid which wets the annular wall means, thereby making the introduction of additional liquid, as by the weir 67, unnecessary.

The ash particles and coal particles, entrained in the carrier medium, are delivered into the separation zone on a tangential path and spiral downwardly through the separation zone, as indicated by the arrow in the drawing, thereby exerting a centrifugal force on the particles, thrusting them to the wall of vessel 59. The aqueous layer retains at least a portion of the ash-fraction coming in contact therewith and the ash-laden aqueous liquid is collected, e.g., in sump 69, and removed from the separator through take-off pipe 71. The continuous flow of water from weir 67 retards accumulation of particulate material on the vessel walls. Due to their hydrophobicity, the particles constituting the coal fraction do not become associated with the water, but travel downwardly within the separation zone and are withdrawn along with the carrier medium through the central discharge 63. As shown in the drawing, discharge 63 is preferably positioned at one end of a tubular duct 73 which extends axially into the separation zone from the inlet of the separation vessel. Additional separation of heavier particles is achieved by a reversal of flow, as indicated by the arrows. The heavier particles in the downward spiral flow tend to continue their downward movement and are collected in the sump 69 whereas the lighter particles constituting the coal fraction, are able to reverse their direction of movement and are exhausted with the carrier medium through the discharge 63.

The separator may be as large as practical so as to lengthen the particle path and increase the residence time of the particles in the separator.

The particulate coal, which is entrained in the carrier medium as it is discharged from separator 17, is thereafter mixed with a suitable liquid in mixing vessel 19. The mixing vessel illustrated in the drawing has an inlet 75 for the introduction of the effluent from separator 17, a receiver 79, and an outlet 81 for discharging the particulate coal-in-liquid mixture from the receiver. In the particular arrangement shown in the drawing, the liquid is sprayed through nozzle 77 into the coal-carrier medium mixture as it flows through duct 23. The two components are intimately mixed, for example by centrifugal action, in mixing vessel 19, and the mixture is discharged through outlet 81 which is controlled by discharge means 83. Excess carrier medium is exhausted as shown by the dotted arrow, at 85. Additional amounts of liquid may be introduced into receiver 79 via nozzles 87, 87'.

The composition of the particulate coal-in-liquid mixtures produced in accordance with the present invention may vary widely. In the case of composite fuels, for example, a flowable composite may be formed by mixing the finely divided coal with at least 50 percent oil by weight of the mixture; a paste may be formed by mixing the coal with from about 10 percent to about 40 percent oil by weight of the mixture; or a granular coal-in-oil agglomerate may be formed by mixing the coal with as little as 1 to 10 percent oil by weight of the mixture. Aside from being a useful combustible fuel, the granular coal-in-oil composition just described may conveniently undergo subsequent processing such as coking, gasification or hydrogenation.

The process of the present invention is preferably carried out by employing the above-described apparatus in the following manner.

Coal is crushed to about ¼" and fed to the superheated steam-driven fluid energy mill 11 via feed unit 13 in which the coal is heated indirectly by the introduction of steam into jacket 43. The coal is preferably heated above the vaporization temperature of water, but below the temperature at which the coal reacts with water vapor to generate carbon monoxide, or reacts with oxygen to form carbon dioxide. The indirect heat exchange effected in this manner between the steam and the coal evaporates moisture associated with the coal, thus producing water vapor which escapes through vent 49 taking with it any air entrained in the feed coal. In the mill 11, the deaerated coal is reduced to particles comprising a coal-fraction and an impurities-fraction by the action of sonic velocity superheated steam jets introduced through ejector nozzles 27. A vortex is generated about the vertical axis of vessel 31 and is given an axial component with the result that the contents of the vessel are directed upwardly through the core zone and oversized particles are cast outwardly into the peripheral zone wherein those particles are drawn downwardly and back into the grinding zone for further size reduction. Micron-sized coal and ash particles of a maximum size ranging from about 40 to about 5 microns (i.e., 100 percent passing through a 325 mesh screen) are exhausted from the mill entrained in spent steam. The coal particles are hydrophobic, porous and highly surface reactive and the ash particles are hydrophilic and partially dehydrated.

Water is sprayed into the two fractions upon discharge from the mill by spray nozzle **15*b* to reduce the temperature of the steam to about 220° F. and to provide a small amount of condensed water which nucleates on the hydrophilic ash particles to the extent of about 3 percent up to about 100 percent or more of the weight of the ash particles. Water does not nucleate on the hydrophobic coal particles. Both fractions are transferred to the water-wall separator vessel 59 wherein the ash particles are captured in the water at the outer periphery of the separation zone, and collected as a slurry in sump 69. The wetted ash particles tend to agglomerate, thus substantially growing in mass and increasing the forces acting to carry them to the wall of vessel 59 and into the sump 69. The coal particles, being extremely hydrophobic, are repelled by the water wall, and, entrained in the remaining steam, are exhausted through the separator's discharge 63 and through duct 23 into mixing vessel 19**.

The coal-steam mixture which passes through duct 23 is sprayed with a suitable liquid from nozzle 77. When the particulate coal is mixed with oil, for example, the sprayed oil droplets are attracted to the coal particle surfaces, thereby forming agglomerates of the two substances. The coal-in-oil mixture is then introduced into a mixing vessel 19, such as the cyclone collector illustrated in the drawing. Depending on the amount of oil sprayed through nozzle 77, the cyclone can operate as a dry or as a wet collector, discharging granular coal-in-oil agglomerates or flowable coal-in-oil composites, as previously described, into the receiver 79. The coal-in-oil mixture may be removed from the receiver 79 by discharge means 83, which may be either a rotary valve in case of granular agglomerates, or a pump in case of flowable composites. The remaining carrier steam is exhausted at 85.

There are quite a number of different liquids which may be used to prepare the coal-in-liquid mixtures of the present invention, hydrocarbons being the preferred liquids. However, hydrocarbon derivatives are also useful. For example, in order to obtain a mixture suitable for hydrogenation the following hydrogen donor solvents may be used: solvents derived from coal pyrolysis and hydrogenation; aromatic and polynuclear aromatics, such as benzene, napthalene, phenanthrene, and various derivatives thereof; and aromatic petroleum oils. Mixtures suitable for gasification may include the following liquids: residual fuel oils; oils derived from liquification of coal; used lubricating oils; and sludges containing carbonaceous substances. Composite fuels made in accordance with the present invention may contain various grades or types of oil, such as: residual fuel oils; oils derived from liquification of coal; and surplus distillate fuel oils.

As previously mentioned, certain applications of finely divided coal involve forming mixtures of the coal with water. In order to form coal-in-water mixtures in accordance with this invention, it is necessary to treat the coal with a surfactant prior to mixing with water since the micron-sized coal produced in carrying out the present invention is extremely hydrophobic. Suitable surfactants for this purpose include acetylenic alcohols, glycols and ethoxylated forms thereof; polyethoxylated oils, fatty alcohols, acids, esters and ethers; organic sulfates, sulfonates, amines and polyethoxylated derivatives thereof; salts of sulfated alcohols, and polyehtoxylated forms thereof; and organic phosphate esters. Treatment of the coal with the surfactant may be accomplished by introducing the surfactant into the coal through nozzle 77 as the coal-carrier medium mixture enters mixing vessel 19. The surfactant should be sprayed as an aqueous solution of about 1 part surfactant to 10 parts water and at a rate of about 3 parts to about 10 parts per 100 parts of coal, all percentages being by weight. Water may thereafter be mixed with the coal by spraying through nozzles 87, 87' as the pretreated coal collects in receiver 79. The resultant coal-in-liquid mixture should contain about ½ percent to about 3 percent of surfactant based on the weight of the water. If the percentage of the water in the mixture is increased to beyond 45–50 percent, the coal tends to separate from the mixture.

Alternatively, the entire amount of water and surfactant may be sprayed into the coal-steam mixture with mixing vessel 19 then being operated as a wet cyclone.

As a source of water injected through nozzles 77, and 87 and 87', carrier steam discharged through mixer outlet 85 may be passed through a condenser (not shown) with the condensate therefrom pumped in required quantities to the injection nozzles.

Although the principle underlying the present invention is not completely understood, it is believed that the superior surface reactively and hydrophobicity of the micron-sized coal produced in carrying out the present invention, as compared with that produced in grinding processes that have been utilized heretofore, is attributable to grinding the coal in an air-free atmospheres. When air is present in a steam driven mill, it is thought that very short-lived, high-temperature conditions exist on the surfaces of colliding particles so that oxygen in the air will react with the coal, deactivate free radicals, and consume hydrogen which is produced when the carbon particles react with the steam and which would otherwise unite with the unsaturated coal structure to increase its hydrophobicity.

The nitrogen in air is also believed to have an inhibiting effect on the surface reactivity and hydrophobicity of the finely divided coal produced in accordance with the present invention.

It is further believed that when air is excluded from the mill and a water vapor molecule is caught in a collision between two coal particles, oxygen atoms present in the steam become associated with carbon atoms of the coal particles and the hydrogen atoms, associated with, but widely separated from each other by the oxygen atoms in steam, are increasingly attracted to neighboring carbons with the end result being that one carbon atom will unite with an oxygen and two other carbons will unite with the hydrogens, carbon monoxide being removed in the gaseous state and the hydrogenated carbons remaining as part of the molecular structure of the caol particle surfaces. By this mechanism, a hydrogen enrichment of the coal particle surfaces may be effected.

In practicing the present invention with No. 6 fuel oil, for example, it has been observed that the coal and oil interact exothermally during preparation of the mixture. This observation lends support to the theory of molecular fragmentation at the surface of the coal particles which are then sufficiently reactive to unite with the hydrocarbon structure of the oil.

It has also been noted that the coal particles produced in accordance with the present invention are substantially spheroidal in shape, as opposed to the coal platelets which are typically produced in air-swept mechanical mills. This spheroidal shape of the coal particles is believed necessary for obtaining stable mixtures with oil.

The invention will be further understood by reference to the following examples setting forth the presently preferred specific parameters which may be suitable for producing coal-in-liquid mixtures of varying composition.

EXAMPLE I

A flowable particulate coal-in-oil mixture may be produced in accordance with the following procedure.

Forty thousand pounds of pre-crushed coal ($\frac{1}{4}'' \times 0$) containing 14 percent moisture, and 10 percent ash is fed into hopper 55 at 60° F. Steam at 700° F./450 psia is supplied by boiler 57. A portion of the steam from boiler 57 is introduced into drier steam jacket via supply duct 45. The moisture content of the coal may be reduced by 10 percent or 4,000 pounds of moisture per hour, which may be evaporated and vented with air entrained in the feed coal through vent 49. Under these conditions, it is estimated that 36,000 pounds of coal per hour containing approximately 1,600 pounds of unevaporated moisture will be fed into mill 11 through inlet 25 at a temperature of 220° F. Hence, 5,024 pounds per hour of high pressure steam will be condensed in the drier and returned to boiler 57 by pump 58.

Steam for the mill 11 will be throttled from 450 psia to 200 psia through regulating means 37 in supply line 33 and steam conditions at the ejector nozzles 27 should then be 670° F./200 psia. 27,000 pounds per hour of steam will be expelled through the nozzles to reduce the coal to a product comprising 30,400 pounds of dehydrated coal particles, 4,000 pounds of ash particles, the average particle size of each type being $20\mu \times 0$ and 28,600 pounds of steam which may be exhausted through outlet 29 at 305° F. The exhausted mixture will next traverse spray nozzle **15*b* wherein water at 60° F. will be sprayed from a source (not shown) at a rate of 10,000 pounds per hour which is anticipated to result in a mill effluent flow which contains, on a per hour basis, 30,400 pounds of coal, 4,000 pounds of ash, 28,757 pounds of steam at 220° F. and 9,843 pounds of water. The coal and ash fractions will thereafter be introduced via inlet 61 on a tangential path into separator vessel 59** to produce a coal product which should contain as little as ½ percent to 5 percent of ash depending upon the nature and amount of impurities in the raw coal.

The steam-entrained coal that is discharged from separator 17 through duct 23 traverses oil spray nozzle 77 which may spray up to about 3,750 gallons of residual fuel oil onto the passing coal particles in a finely divided spray. The resultant mixture is then introduced into mixing vessel 19 on a tangential path which is operated as a wet centrifugal scrubber. The downwardly spiralling oil-wet coal particles are centrifuged onto the collector walls being forced downwardly by the forces of gravity and the downward gas flow until they are discharged centrifugally into receiver 79. The scrubbed carrier medium is exhausted from vessel 19 at 85, and the coal-in-oil mixture is removed by discharge means 83, which in this instance is a pump. When operating in accordance with the foregoing procedure, there should be produced on an hourly basis a composite fuel containing 30,400 pounds of coal, an equal quantity of oil and only 800 pounds of ash. This ash content should be about 1.3 percent by weight of the total mixture, i.e., about 0.878 pounds per million BTU of heating value.

EXAMPLE II

A granular coal-in-oil agglomerate may be produced in accordance with the following procedure.

Finely divided coal which has been separated from ash, as described in the preceeding example, is carried by steam through duct 23 and is sprayed with oil from nozzle 77. On an hourly basis, a mixture of 30,400 pounds of micron-sized coal and 28,757 pounds of steam are sprayed with 112 gallons of oil.

The mixture of coal and oil is introduced into mixing vessel 19 on a tangential path and is subjected to centrifugal mixing forces. In this example, vessel 19 is operated as a dry cyclone collector. Coal particles wet by the oil are of increased mass and tend to form relatively heavy agglomerates. The oil-wet coal is discharged into receiver 79 and the spent steam is exhausted at 85. Discharge means 83, which in this instance is a rotary seal valve, removes the coal-in-oil mixture from receiver 79. The coal-in-oil mixture thus produced will contain 30,400 pounds of substantially clean coal and 913 pounds of oil, or about 3% oil by weight of the mixture.

EXAMPLE III

In this example, a coal-in-oil paste may be formed from the granular coal-in-oil agglomerate of the preceeding example by introducing into receiver 79 along with the agglomerate a spray of oil from nozzles 87, 87'. Thus, a mixture of 30,400 pounds of particulate coal and 913 pounds of oil contained in receiver 79 may be sprayed with an additional 896 gallons of oil through nozzles 87, 87' to produce a paste having an oil content of about 21.3% oil by weight of the mixture.

EXAMPLE IV

In this example, a coal-in-water mixture was prepared after pre-treatment of the coal with a surfactant. 1200 parts of coal were pre-treated with 10 parts sodium lauryl sulfate and 1 part polyethoxylated alcohol (GAF EP-110). The pre-treated coal was thereafter mixed with 1000 parts water to give a flowable mixture suitable for gasification or boiler fuels.

While a presently preferred embodiment of the invention has been illustrated and described hereinabove, those skilled in the art will appreciate that variations are possible in the apparatus employed in practicing the invention. For example, a grinding mill other than the steam-driven fluid energy mill described hereinabove may be employed in practicing the invention, so long as the mill is capable of producing micron-sized coal and impurities particles in the absence of air. Likewise, other separators which are capable of classifying solid particles on the basis of their affinity for, or attraction by water may be employed instead of the water-wall separator described hereinabove. One such alternative separator is the Venturi apparatus disclosed in my copending application Ser. No. 93,870, filed Nov. 13, 1979, entitled "Coal Treatment Process," the entire disclosure of which is incorporated herein by reference. Other vessels for mixing finely divided coal with oil may be employed in practicing the present invention, such as the vessel described in U.S. Pat. No. 1,390,231.

Those skilled in the art will appreciate that the particular embodiments of the process and products described in the foregoing examples are merely illustrative and are capable of wide variation and modification without departing from the scope of the invention as defined in the appended claims.

I claim:

1. An improved process for producing a particulate coal-in-liquid mixture comprising:

a. grinding raw coal to a particle size of less than about 40 microns in a substantially air-free environment using a gaseous carrier medium to form a hydrophobic coal-fraction and a hydrophilic ash-fraction;

b. contacting said fractions with an aqueous liquid whereby the particles constituting the ash fraction are wetted, but the particles constituting the coal fraction are left substantially dry;

c. separating the ash particles from the coal particles; and d. mixing the coal particles with liquid.

2. The process of claim 1, wherein the liquid is a hydrocarbon.

3. The process of claim 1, wherein the liquid is a hydrocarbon derivative.

4. The process of claim 1, wherein the liquid is a hydrogen donor solvent.

5. The process of claim 4, wherein the hydrogen donor solvent is a product of coal pyrolysis or hydrogenation.

6. The process of claim 4, wherein the hydrogen donor solvent is an aromatic petroleum oil.

7. The process of claim 4, wherein the hydrogen donor solvent is an aromatic or polynuclear aromatic substance.

8. The process of claim 1, wherein the liquid is an oil.

9. The process of claim 8, wherein the oil is a residual fuel oil.

10. The process of claim 8, wherein the oil is a distillate fuel oil.

11. The process of claim 1, wherein the liquid comprises water and a surfactant or a mixture of surfactants.

12. An improved process for producing a particulate coal-in-liquid mixture comprising:

a. deaerating raw coal;

b. grinding said coal to a particle size of less than about 40 microns in a substantially air free environment to form a hydrophobic coal-fraction and a hydrophilic ash-fraction;

c. contacting said fractions with an aqueous liquid whereby the particles constituting the ash-fraction are wetted but the particles constituting the coal fraction are left substantially dry;

d. separating the ash particles from the coal particles; and e. mixing the coal particles with liquid.

13. The process of claim 12, wherein the liquid is a hydrocarbon.

14. The process of claim 12, wherein the liquid is a hydrocarbon derivative.

15. The process of claim 12, wherein the liquid is a hydrogen donor solvent.

16. The process of claim 15, wherein the hydrogen donor solvent is a product of coal pyrolysis or hydrogenation.

17. The process of claim 15, wherein the hydrogen donor solvent is an aromatic petroleum oil.

18. The process of claim 15, wherein the hydrogen donor solvent is an aromatic or polynuclear aromatic substance.

19. The process of claim 12, wherein the liquid is an oil.

20. The process of claim 19, wherein the oil is a residual fuel oil.

21. The process of claim 19, wherein the oil is a distillate fuel oil.

22. The process of claim 12, wherein the liquid comprises water and a surfactant or a mixture of surfactants.

23. An improved process for producing a particulate coal-in-liquid mixture comprising:

a. heating raw coal to reduce the moisture content thereof;

b. deaerating the coal;

c. grinding said coal to a particle size of less than about 40 microns in a substantially air free environment to form a hydrophobic coal-fraction and a hydrophilic ash-fraction;

d. contacting said fractions with an aqueous liquid whereby the particles constituting the ash-fraction are wetted but the particles constituting the coal-fraction are left substantially dry;

e. separating the ash particles from the coal particles; and f. mixing the coal particles with liquid.

24. The process of claim 23, wherein the liquid is a hydrocarbon.

25. The process of claim 23, wherein the liquid is a hydrocarbon derivative.

26. The process of claim 23, wherein the liquid is a hydrogen donor solvent.

27. The process of claim 26, wherein the hydrogen donor solvent is a product of coal pyrolysis or hydrogenation.

28. The process of claim 26, wherein the hydrogen donor solvent is an aromatic petroleum oil.

29. The process of claim 26, wherein the hydrogen donor solvent is an aromatic or polynuclear aromatic substance.

30. The process of claim 23, wherein the liquid is an oil.

31. The process of claim 30, wherein the oil is a residual fuel oil.

32. The process of claim 30, wherein the oil is a distillate fuel oil.

33. The process of claim 23, wherein the liquid comprises water and a surfactant or a mixture of surfactants.

34. The process according to claims 1, 12, or 23 wherein said separating step is carried out in a separation vessel having an inlet, a discharge, and wall means disposed between said inlet and said discharge defining a separation zone, said separation zone being surrounded at its outer periphery by an aqueous separation medium, and said separating step comprises subjecting said fractions to centrifugal force in said separation zone, collecting a substantial portion of the ash-fraction in said aqueous medium, and exhausting the coal-fraction from the interior of said separation zone through said discharge.

35. The process according to claim 23 wherein heating and deaerating of the coal are carried out simultaneously.

36. The process according to claims 1, 12, 23, or 35 wherein the steps of said process are carried out continuously.

37. The product produced according to the process of any one of claims 1 through 33.

38. A stable particulate coal-in-liquid mixture wherein the coal particles have a particle size of less than 40 microns and are hydrophobic without the presence of a stabilizing agent in said mixture, said mixture having a ash content of less than about 5% of its total weight, and the ratio of ash to coal in said mixture being less than the ratio of ash to coal in the raw coal from which said mixture is produced.

39. The product of claim 38, wherein the liquid is a hydrocarbon.

40. The product of claim 38, wherein the liquid is a hydrocarbon derivative.

41. The product of claim 38, wherein the liquid is a hydrogen donor solvent.

42. The product of claim 41, wherein the hydrogen donor solvent is a product of coal pyrolysis of hydrogenation.

43. The product of claim 41, wherein the hydrogen donor solvent is an aromatic petroleum oil.

44. The product of claim 41, wherein the hydrogen donor solvent is an aromatic or polynuclear aromatic substance.

45. The product of claim 38, wherein the liquid is an oil.

46. The product of claim 45, wherein the liquid is a residual fuel oil.

47. The product of claim 45, wherein the oil is a distillate fuel oil.

48. The product of claim 38, wherein the liquid comprises water and a surfactant or a mixture of surfactants.

49. The particulate coal-in-liquid mixture of claim 38 wherein said coal particles are rendered hydrophobic as a result of being produced by grinding raw coal in a substantially air-free environment.

* * * * *